US007793484B2

(12) United States Patent
Santi

(10) Patent No.: US 7,793,484 B2
(45) Date of Patent: Sep. 14, 2010

(54) FOLDING UNIT FOR POURABLE FOOD PRODUCT PACKAGING MACHINES

(75) Inventor: Franco Santi, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 87 days.

(21) Appl. No.: 11/920,120

(22) PCT Filed: May 17, 2006

(86) PCT No.: PCT/EP2006/062402

§ 371 (c)(1),
(2), (4) Date: Dec. 16, 2008

(87) PCT Pub. No.: WO2006/122962

PCT Pub. Date: Nov. 23, 2006

(65) Prior Publication Data

US 2009/0113848 A1 May 7, 2009

(30) Foreign Application Priority Data

May 19, 2005 (EP) ..... 05425345

(51) Int. Cl.
*B65B 7/18* (2006.01)

(52) U.S. Cl. ..... 53/375.5; 53/374.7

(58) Field of Classification Search ..... 53/374.7, 53/375.2, 375.5, 375.7, 387.3, 371.7, 372.2, 53/372.5, 372.7

See application file for complete search history.

(56) References Cited

U.S. PATENT DOCUMENTS 4,034,537 A 7/1977 Reil et al.
4,387,547 A * 6/1983 Reil ..... 53/551
4,614,079 A * 9/1986 Ida et al. ..... 53/372.3
4,776,147 A * 10/1988 Konzal et al. ..... 53/374.7
5,031,385 A * 7/1991 Wada ..... 53/551
5,836,139 A * 11/1998 Yoshida et al. ..... 53/387.3
5,966,899 A * 10/1999 Fontanazzi ..... 53/374.7

FOREIGN PATENT DOCUMENTS

EP 0 819 602 A2 1/1998
EP 0 887 261 A1 12/1998
FR 2 821 607 A1 9/2002

OTHER PUBLICATIONS

International Search Report for PCT/EP2006/062402 dated Aug. 8, 2006.

* cited by examiner

*Primary Examiner*—Stephen F Gerrity
(74) *Attorney, Agent, or Firm*—Buchanan Ingersoll & Rooney PC

(57) ABSTRACT

A folding unit for producing packages of pourable food products from sealed packs having at least one projecting foldable end tab. At least one conveying member cyclically receives a relative pack, by the end corresponding to the tab, and feeds the pack along a forming path crosswise in the axis of the pack. A folding mechanism having an impact surface receives each pack by the end corresponding to the tab, and is carried by the conveying member to move between a first operating position, in which the impact surface forms, with the feed direction of the relative pack, an angle of over 90° and open in the direction of the forming path, to fold the relative tab, upon impact, onto the pack in the traveling direction of the pack, and a second operating position, in which the impact surface is rotated towards and cooperates with the pack.

14 Claims, 5 Drawing Sheets

1
2
3
7
8
9
10
11
13
14
20
21
22
23
24
25
26
27
28
30
31
32
32a
32b
33
33a
33b
35
36
37
40
41
42
43
45
46
47
48
49
50
51
A,C
B
B1
B3
D

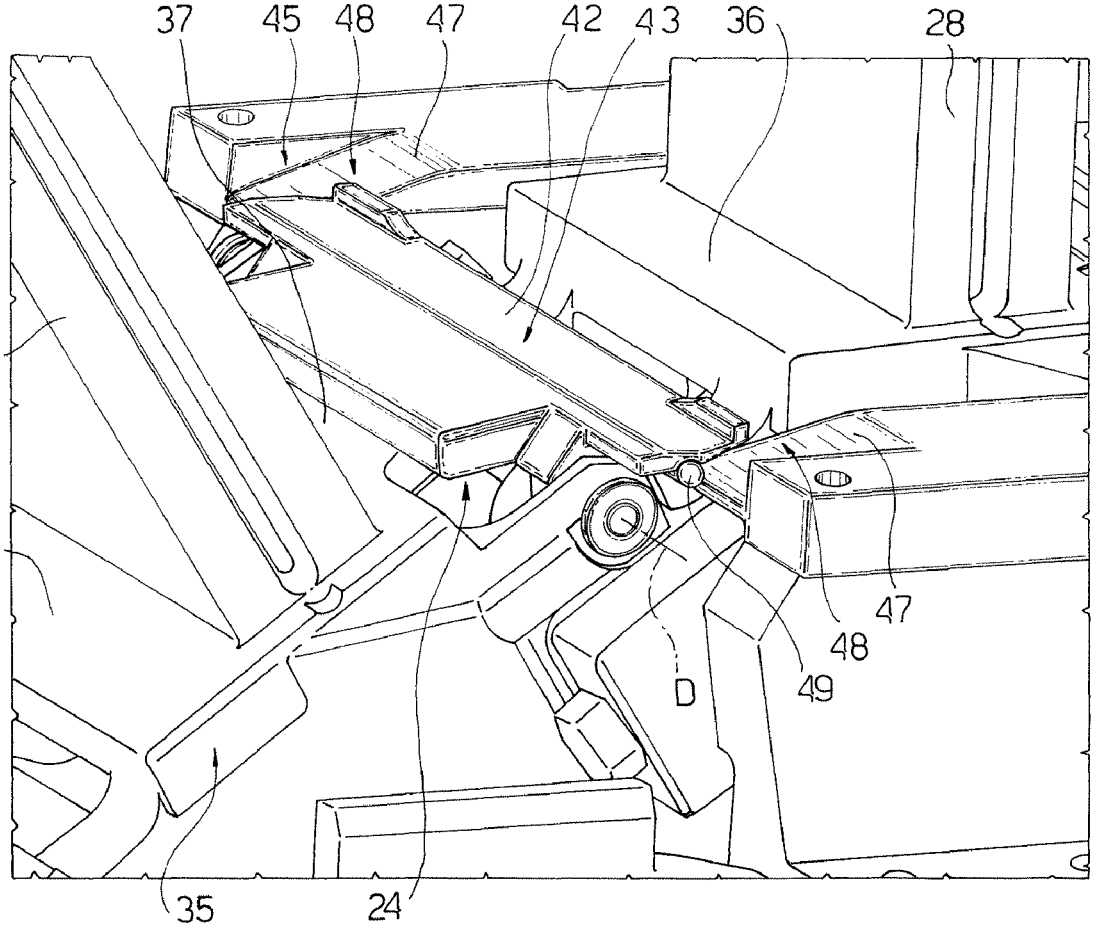
Fig.8
Fig. 9
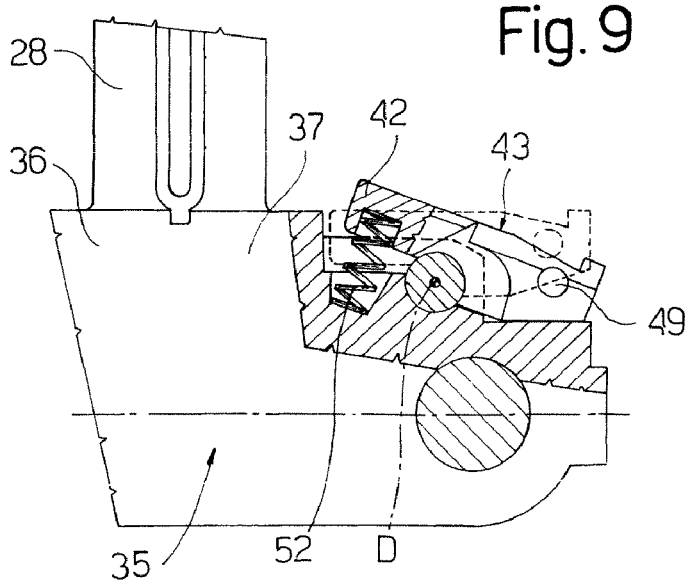

FOLDING UNIT FOR POURABLE FOOD PRODUCT PACKAGING MACHINES

TECHNICAL FIELD

The present invention relates to a high-speed folding unit for packaging machines for continuously producing sealed packages of pourable food products from a tube of packaging material.

Many pourable food products, such as fruit juice, pasteurized or UHT (ultra-high-temperature treated) milk, wine, tomato sauce, etc., are sold in packages made of sterilized packaging material.

BACKGROUND ART

A typical example of this type of package is the parallelepiped-shaped package for liquid or pourable food products known as "Tetra Brik" or Tetra Brik Aseptic (registered trademarks), which is made by folding and sealing laminated strip packaging material. The packaging material has a multilayer structure comprising a layer of fibrous material, e.g. paper, covered on both sides with layers of heat-seal plastic material, e.g. polyethylene. In the case of aseptic packages for long-storage products, such as UHT milk, the packaging material comprises a layer of barrier material, e.g. aluminum foil, which is superimposed on a layer of heat-seal plastic material, and is in turn covered with one or more layers of heat-seal plastic material eventually forming the inner face of the package contacting the food product.

As is known, packages of this sort are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, after sterilization, is removed, e.g. evaporated by heating, from the surfaces of the packaging material; and the web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which are then fed to a folding unit to form the finished, e.g. substantially parallelepiped-shaped packages.

More specifically, the pillow packs substantially comprise a parallelepiped-shaped main portion; and opposite top and bottom end portions projecting laterally on opposite sides of the main portion and defining respective triangular end flaps to be folded onto the main portion.

A longitudinal sealing strip, formed when sealing the packaging material to form the vertical tube, extends along the pillow packs; and the end portions of each pillow pack have respective transverse sealing strips perpendicular to the relative longitudinal sealing strip and defining respective end tabs projecting from the top and bottom of the pack.

The end portions of each pillow pack taper towards the main portion from the respective end tabs, and are pressed towards each other by the folding unit to form flat opposite end walls of the pack, while at the same time folding the end flaps onto respective walls of the main portion.

Packaging machines of the above type are known, in which the pillow packs are folded to form the parallelepiped-shaped packages by means of folding units substantially comprising a conveyor for feeding the packs along a forming path; a number of folding members located along the forming path and interacting with the packs to flex the packaging material along preformed fold lines; a heating assembly which acts on the flaps of each pack to be folded to heat seal the flaps to respective walls of the pack; and a final pressure device which cooperates with each pack to hold the flaps on the relative walls as the flaps cool.

Because of the normal position in which the pillow packs are fed to the folding unit, and the forward movement of the conveyor through the folding members, the end tabs are folded "naturally" onto the relative end walls of the packs, onto the side without the longitudinal sealing strip, i.e. in the opposite direction to the travelling direction of the conveyor.

Though extremely easy to perform, the above method of folding the end tabs reduces the space left on the top end walls of the packages to apply reclosable opening devices.

As is known, opening devices cannot be applied to the sealing areas of the packages, because of the problems posed by heat sealing the opening devices onto uneven surfaces, and to avoid impairing the seals on the packages themselves.

As a result, opening devices can only be applied to the small flat areas adjacent to the sealing strips on the top end walls of the packages, which obviously limits the maximum size of the opening devices.

This limitation is further compounded in view of the increasing number of food products of different physical characteristics packaged as described above, i.e. in packages made of paper packaging material. In particular, certain food products, especially semiliquid products or products containing fibre or particles, necessarily call for larger opening devices to permit correct pour-out of the product with no clogging.

To increase the space on the packages in which to apply the opening devices, it has been proposed to invert the direction in which the end tab is folded onto the relative top end wall, by easing it onto the same side as the longitudinal seal.

The folding direction of the end tabs of the packs is normally inverted by gradually deforming the tabs by means of appropriately shaped contrasting surfaces, against which the packs slide as they travel along the forming path.

Though advantageous in many respects, the above method of folding the end tabs of the packs fails to ensure total repeatability and reliability of the folding operation.

DISCLOSURE OF INVENTION

It is an object of the present invention to provide a folding unit for a pourable food product packaging machine, designed to eliminate the aforementioned drawbacks of known folding units.

According to the present invention, there is provided a folding unit for a pourable food product packaging machine.

BRIEF DESCRIPTION OF THE DRAWINGS

A preferred, non-limiting embodiment of the present invention will be described by way of example with reference to the accompanying drawings, in which:

FIG. 8 shows a larger-scale view in perspective of a detail of the FIG. 1 folding unit;

FIG. 9 shows a larger-scale, partly sectioned side view of a variation of a further detail of the FIG. 1 folding unit.

BEST MODE FOR CARRYING OUT THE INVENTION

Figure 1:
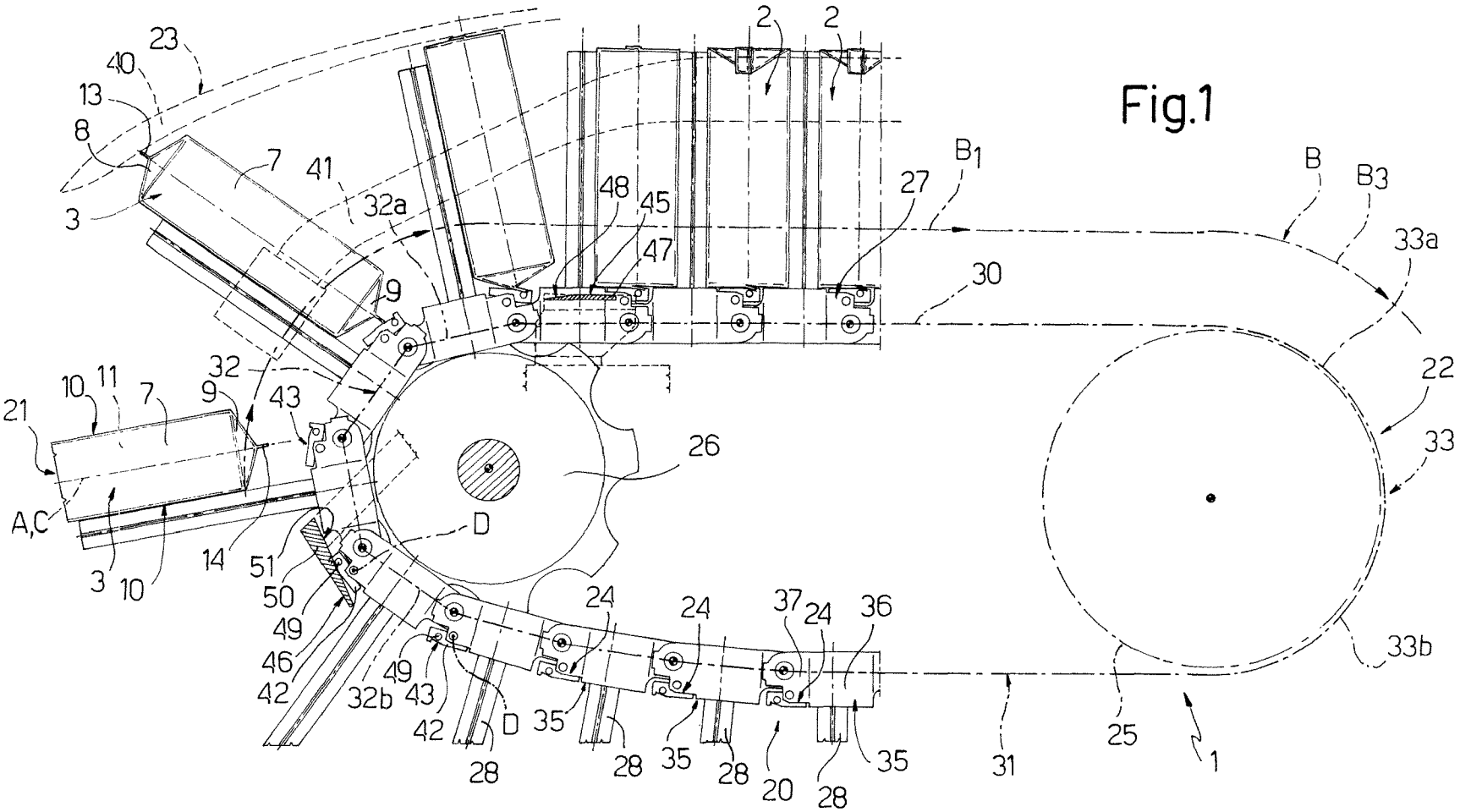
FIG. 1 shows a side view, with parts removed for clarity, of a folding unit in accordance with the present invention for producing packages of pourable food products from sealed pillow packs.

Number 1 in FIG. 1 indicates as a whole a high-speed folding unit for a packaging machine (not shown) for continuously producing parallelepiped-shaped sealed packages 2 of a pourable food product, such as pasteurized or UHT milk, fruit juice, wine, etc., from a known tube of packaging material (not shown).

The tube is formed in known manner upstream from unit 1 by longitudinally folding and sealing a known web (not shown) of heat-seal sheet material, which comprises a layer of paper material covered on both sides with layers of heat-seal plastic material, e.g. polyethylene. In the case of an aseptic package 2 for long-storage products, such as UHT milk, the packaging material comprises a layer of oxygen-barrier material, e.g. aluminum foil, which is superimposed on one or more layers of heat-seal plastic material eventually forming the inner face of the package contacting the food product.

The tube of packaging material is then filled with the food product for packaging, and is sealed and cut along equally spaced cross sections to form a number of pillow packs 3 (FIGS. 1-7), which are then transferred to unit 1 where they are folded mechanically to form respective packages 2.

With reference to FIGS. 1-7, a longitudinal sealing strip 4, formed to produce the tube of packaging material from the web folded into a cylinder, extends along one side of each pack 3, which is closed at the opposite ends by respective transverse sealing strips 5, 6 perpendicular to and joined to longitudinal sealing strip 4.

Each pack 3 has an axis A parallel to longitudinal sealing strip 4, and comprises a parallelepiped-shaped main portion 7; and opposite, respectively top and bottom, end portions 8, 9 tapering from main portion 7 towards respective transverse sealing strips 5, 6.

More specifically, main portion 7 of each pack 3 is bounded laterally by two flat rectangular walls 10 parallel to each other and to axis A, and by two flat rectangular walls 11 extending perpendicularly between walls 10.

Each end portion 8, 9 is defined by two walls 12, each substantially in the form of an isosceles trapezium, and which slope slightly towards each other with respect to a plane perpendicular to axis A, and have minor edges defined by respective end edges of walls 10 of portion 7, and major edges joined to each other by respective sealing strip 5, 6.

Figure 2:
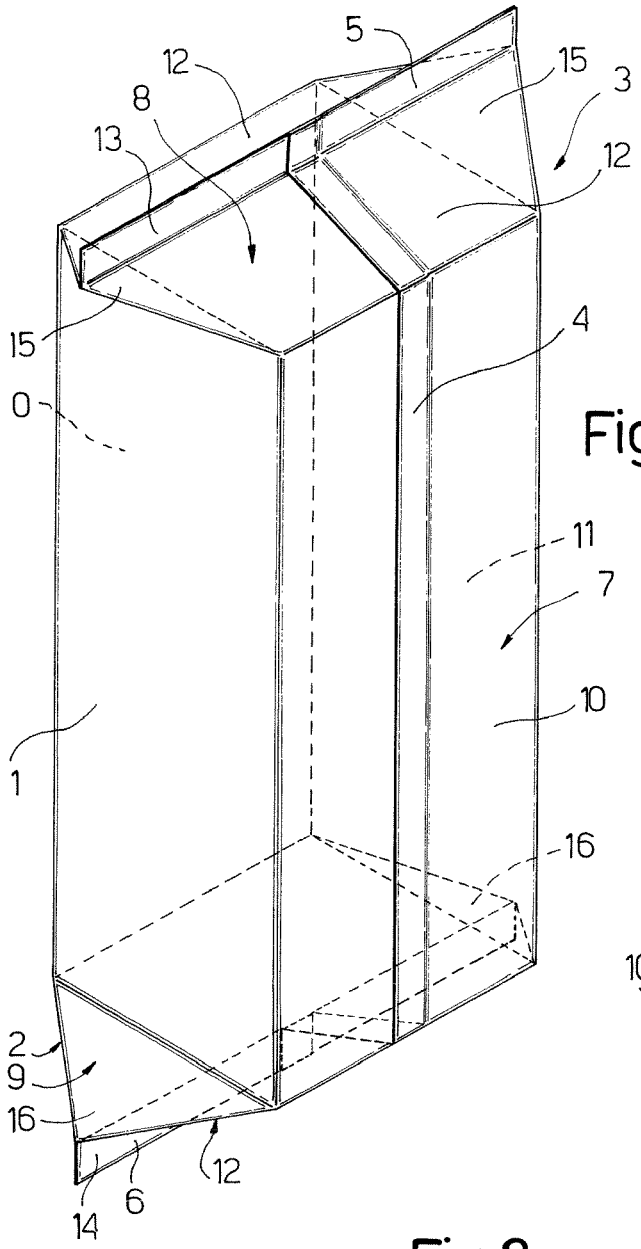
FIG. 2 shows a view in perspective of a pillow pack in the form in which it is fed to the FIG. 1 folding unit.

As shown clearly in FIG. 2, longitudinal sealing strip 4 extends between transverse sealing strips 5 and 6, and along the whole of one wall 10 and the corresponding walls 12 on the same side as wall 10.

Each sealing strip 5, 6 forms a respective substantially elongated rectangular end tab 13, 14 projecting in the direction of axis A from relative pack 3; and two substantially triangular flaps 15, 16 projecting laterally on opposite sides of main portion 7 and defined by end portions of relative walls 12.

To form a package 2, unit 1 presses end portions 8, 9 of relative pack 3 down flat towards each other, and at the same time folds respective tabs 13, 14 onto end portions 8, 9.

With reference to FIGS. 1 and 3-8, unit 1 substantially comprises a chain conveyor 20 for feeding packs 3 continuously along a predominantly straight horizontal forming path B from a supply station 21 to an output station 22 (both shown only schematically); and first and second folding means 23, 24, which cooperate cyclically with each pack 3 to flatten respective end portions 8, 9 of the pack and so fold respective tabs 13, 14 onto end portions 8, 9.

Conveyor 20 comprises at least one gear and, in the example shown, a drive gear 25 and a driven gear 26; and an articulated chain 27 looped about and meshing with gears 25, 26, and supporting a number of flat rectangular paddles 28, each of which projects from chain 27 and cooperates with and pushes a corresponding wall 10 of a relative pack 3 to feed the pack along path B.

Chain 27 comprises a straight horizontal top branch 30; a bottom branch 31 substantially parallel to branch 30; and two curved C-shaped portions 32, 33, which are positioned with their concavities facing, connect branches 30 and 31, and the middle portions of which define supply station 21 and output station 22 respectively.

Path B comprises a straight main portion $B_1$ defined by branch 30 of chain 27; and two, respectively supply and output, end portions $B_2$, $B_3$ defined by respective top portions 32*a*, 33*a* of portions 32, 33 of chain 27 extending between corresponding stations 21, 22 and branch 30. Branch 30 and portions 32*a*, 33*a* of portions 32, 33 therefore define a conveying portion of chain 27 to convey packs 3 from station 21 to station 22, while branch 31 and the remaining portions 32*b*, 33*b* of portions 32, 33 define a return portion of chain 27 to feed paddles 28 from station 22 to station 21.

Chain 27 comprises a number of articulated links 35 defined by substantially flat rectangular plates, from which respective paddles 28 project perpendicularly. More specifically, each paddle 28 extends from an intermediate point of relative link 35, and divides the link into two roughly rectangular supporting portions 36, 37 for supporting packs 3, and which differ in length along path B and are located respectively upstream and downstream from paddle 28 along path B. More specifically, portion 37 is longer than portion 36 along path B.

Given the structure of conveyor 20, paddles 28 are positioned vertically along portion $B_1$ of path B, and assume a roughly horizontal position at stations 21, 22.

Each pack 3 is positioned on conveyor 20 with end portion 9 contacting the conveying portion of chain 27, with one of walls 10 resting against relative paddle 28, and with axis A parallel to paddle 28 and crosswise to path B.

At supply station 21, each pack 3 is fed onto conveyor 20 in a feed direction C, coaxial with axis A of pack 3, and in a horizontal input position in which end portion 9 and relative end tab 14 are positioned facing the conveying portion of chain 27. Similarly, each finished package 2 is removed from conveyor 20 in a horizontal output position (not shown, by not being necessary to a clear understanding of the present invention).

More specifically, along curved portion $B_2$ of path B, given the natural spacing produced between adjacent links 35 of chain 27, end portion 9 of each pack 3 is eased onto supporting portion 37 only of relative link 35; whereas, along straight portion $B_1$ of path B, end portion 9 of each pack 3 contacts both supporting portion 37 of relative link 35 and supporting portion 36 of the preceding link 35.

With particular reference to FIG. 1, folding means 23 comprise a fixed elongated guide member 40, which is positioned facing and a distance from the conveying portion of chain 27, extends along the portion connecting portions $B_1$ and $B_2$ of path B, and defines, on the side facing chain 27, a concave cam surface converging with the conveying portion and which cooperates with end portion 8 of each pack 3 to press it down flat towards chain 27.

The action of guide member 40, combined with the force of gravity, eases packs 3 down towards the conveying portion of chain 27, thus flattening both end portions 8, 9 of packs 3.

Two fixed sides 41 (only one shown schematically by a dash line in FIG. 1), located on opposite sides of conveyor 20, provide for laterally retaining packs along path B.

For each pack 3 fed to unit 1, folding means 24 advantageously comprise a movable plate 42 at least partly defining supporting portion 37 of a relative link 35 of chain 27 and hinged to link 35 about an axis D crosswise to path B and to axis A of pack 3. Each movable plate 42 defines an impact surface 43, which receives relative pack 3 by the tab 14 end, and rotates about axis D between a first and a second operating position designed, with respect to feed direction C and to axis A of packs 3, to allow tab 14 to be folded in the travelling direction of packs 3 along path B.

More specifically, in the first operating position, assumed by each movable plate 42 along portion $B_2$ of path B, relative impact surface 43 forms, with axis A of the pack 3 fed onto it in direction C, an angle of over 90° in the direction of path B, so that, on impacting tab 14, this is folded onto pack 3 in the travelling direction of packs 3 along path B. In the second operating position, assumed along the rest of path B, impact surface 43 is rotated towards pack 3, with which it cooperates to complete folding of relative tab 14 onto pack 3.

More specifically, in the first operating position, impact surface 43 of each movable plate 42 forms, with axis A of the pack 3 fed onto it, or with feed direction C at supply station 21, an angle preferably ranging between 105° and 125° and, in the example shown, an angle of 115°; whereas, in the second operating position, impact surface 43 of each movable plate 42, or movable plate 42 itself, is substantially parallel to path B.

To move relative impact surface 43 from the first to the second operating position, each movable plate 42 is preferably rotated by a fixed first cam device 45 located along the initial portion of straight portion B, of path B; and, to move relative impact surface 43 from the second to the first operating position, each movable plate 42 is rotated in the opposite direction by a fixed second cam device 46 immediately upstream from supply station 21.

With particular reference to FIGS. 1, 5, 6 and 8, device 45 comprises two cam members 47 located on opposite sides of top branch 30 of chain 27 and bounded on top by respective ramp-like guide surfaces 48, which slope upwards in the travelling direction of packs 3 along path B, and which cooperate in sliding manner with movable plates 42 to rotate them from the first to the second operating position. More specifically, each movable plate 42 has two pins 49 projecting laterally from opposite sides of movable plate 42, located downstream from relative axis D along path B, and each cooperating in sliding manner with guide surface 48 of a respective cam member 47.

In the same way (FIG. 1), device 46 comprises two cam members 50 located on opposite sides of curved portion 32 of chain 27 and bounded, on the side facing the outer surface of curved portion 32, by respective ramp-like guide surfaces 51, which slope downwards in the travelling direction of packs 3 along path B, and which cooperate in sliding manner with respective pins 49 of movable plates 42 to rotate the movable plates and so move relative impact surfaces 43 from the second to the first operating position.

Operation of unit 1 will be described with reference to one pack 3 and as of an initial instant, in which pack 3 is fed in direction C onto portion 37 of a relative link 35 of chain 27 of conveyor 20.

Figure 3:
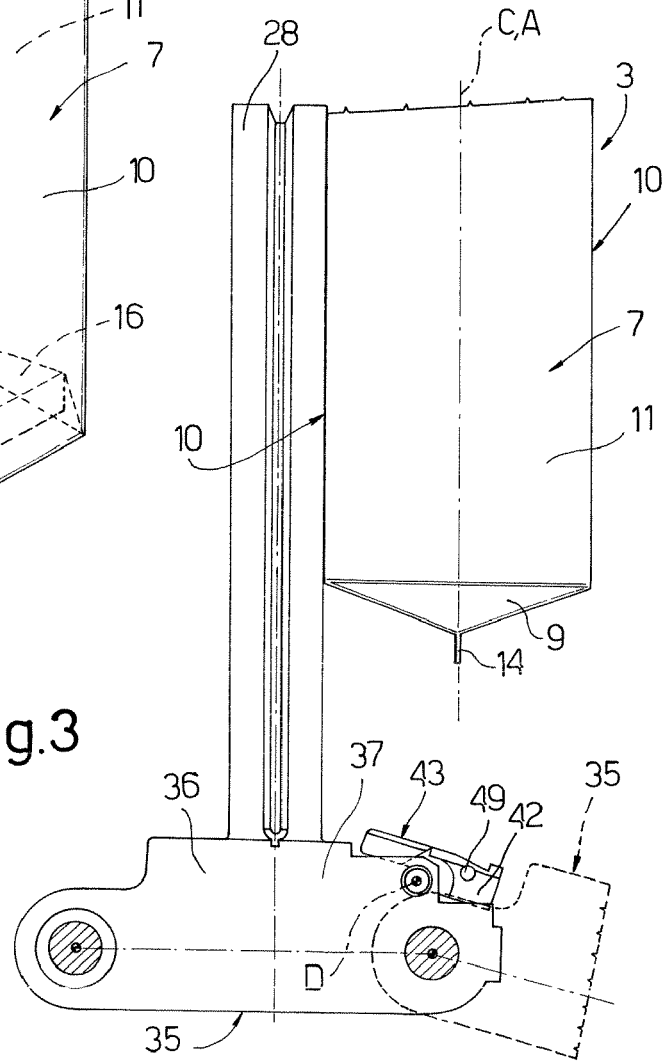
FIGS. 3 to 7 show larger-scale side views of a pillow pack folding sequence performed along a portion of the pack feed path, which, for the sake of clarity, is represented as though it were straight and horizontal.

As shown particularly in FIGS. 1 and 3, pack 3 is positioned with end tab 14 facing portion 37 of link 35, and slides on one wall 10 along relative paddle 28 so that tab 14 is parallel to paddle 28.

Before reaching supply station 21, link 35 travels through and interacts with cam members 50 to rotate relative movable plate 42 about axis D and so move relative impact surface 43 from the second to the first operating position.

The movement of paddle 28 and the thrust exerted by it up-end pack 3 along portion $B_2$ of path B into an upright position by the start of portion $B_1$ of path B. During which movement, end portion 8 of pack 3 cooperates in sliding manner with guide member 40, which, as stated, converges with chain 27 and so combines with chain 27 to press end portions 8 and 9 down flat.

Figure 5:
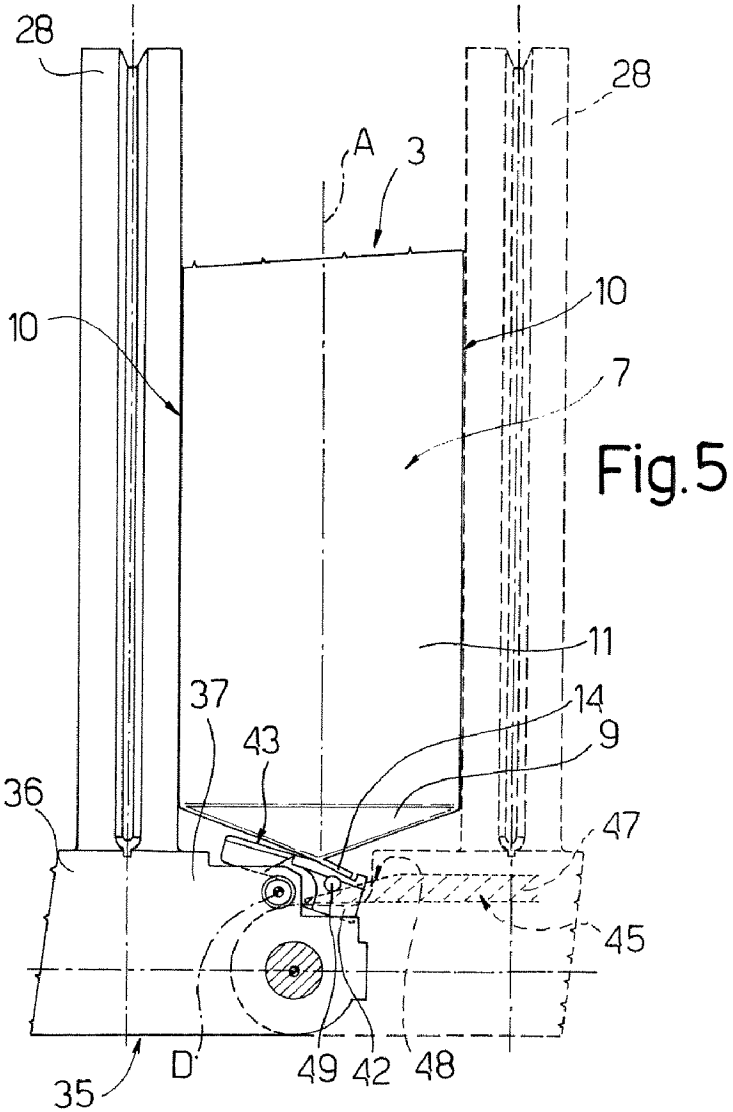
Figure 4:
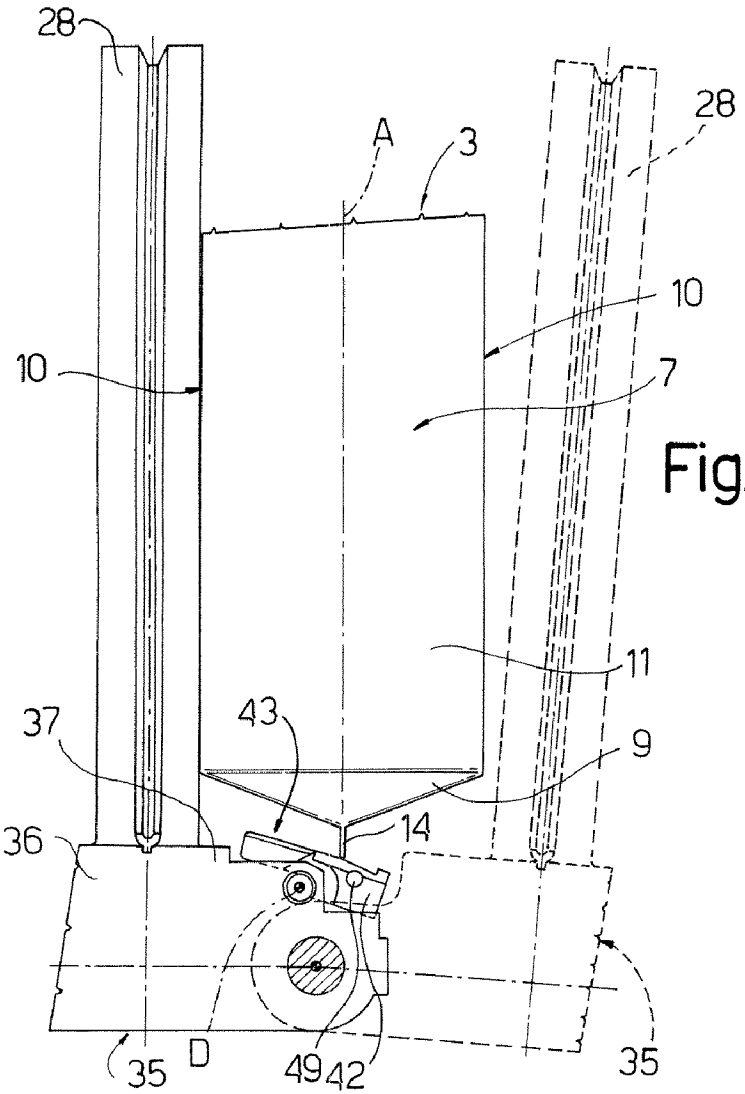
Figure 7:
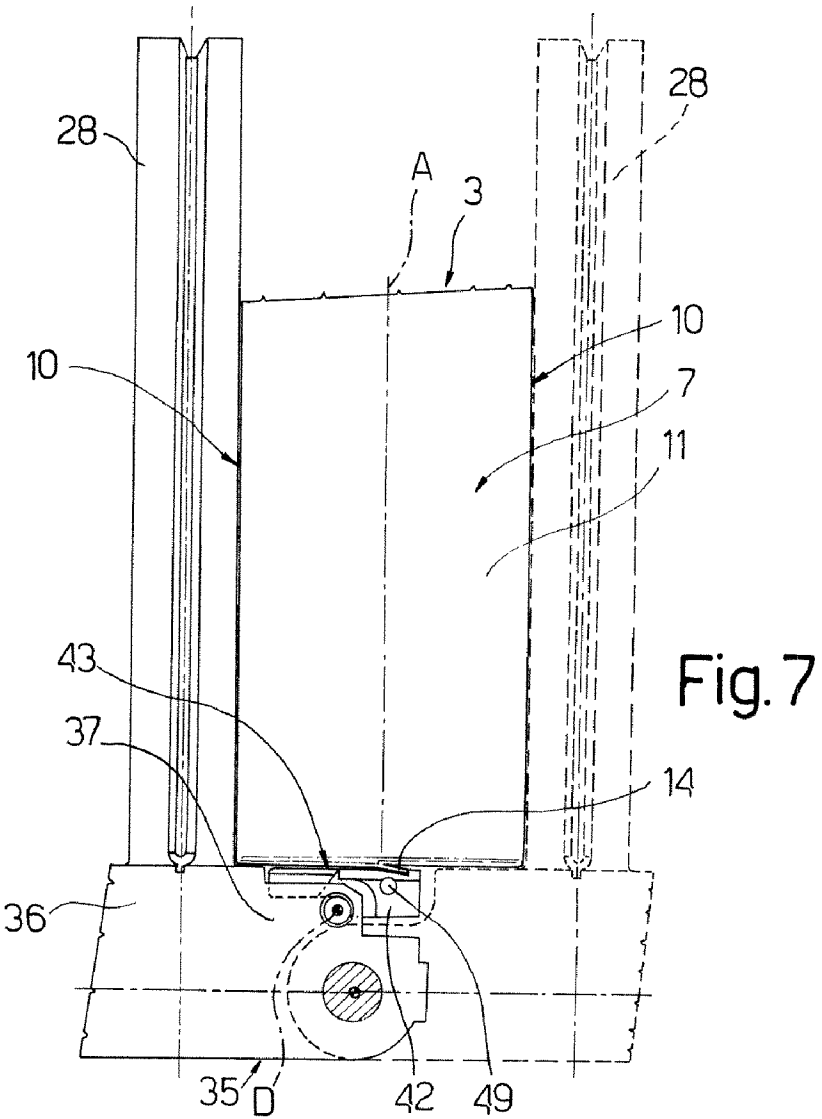
Figure 6:
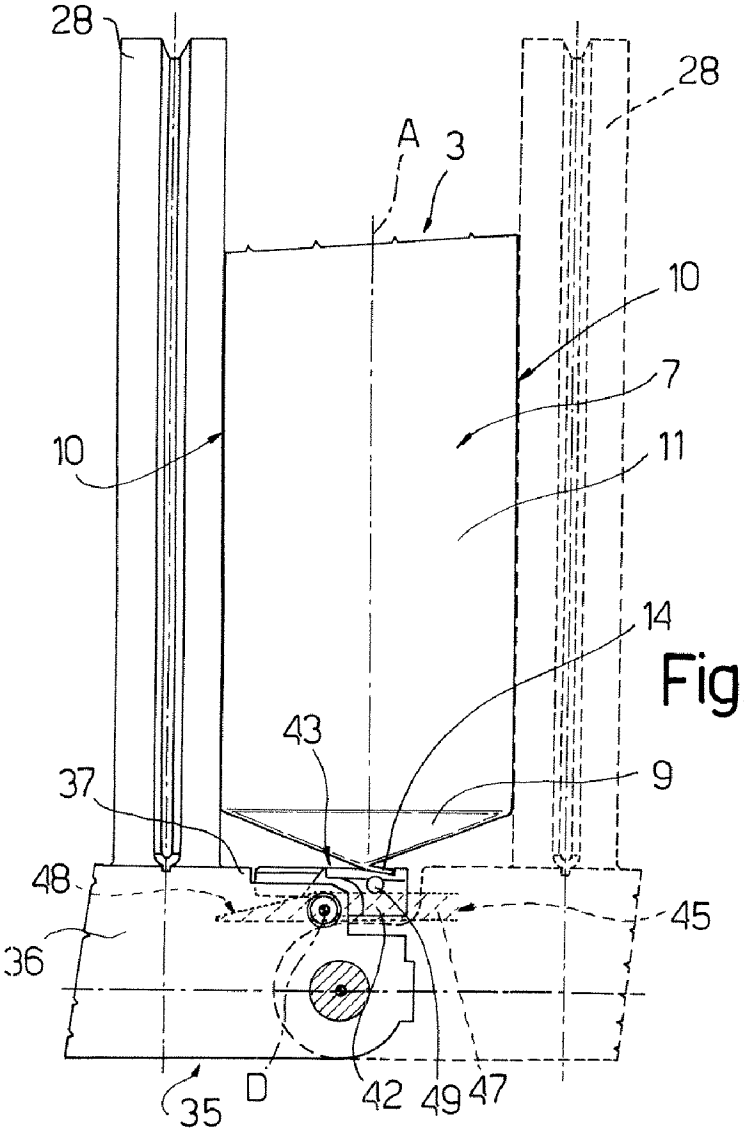

As this is taking place, pack 3 is pushed gradually towards portion 37 of relative link 35 until tab 14 comes to rest on relative impact surface 43 in the first operating position; and, by virtue of the angle of the impact surface and the movement of conveyor 20, tab 14 is gradually folded onto end portion 9 of pack 3 in the travelling direction of the pack along path B (FIGS. 4 and 5).

At the start of portion $B_1$ of path B, link 35 travels through and interacts with cam members 47 to rotate relative movable plate 42 about axis D and so move relative impact surface 43 from the first to the second operating position and, under the weight of pack 3 by now in an upright position, complete folding of tab 14 onto pack 3 so that the tab is substantially parallel to path B.

Pack 3 then undergoes further forming operations, not described or illustrated by not forming part of the present invention, and is then unloaded off conveyor 20 at output station 22.

Once free of pack 3, link 35 is fed back to supply station 21 via cam members 50, which interact with relative movable plate 42 to rotate it about axis D and so move relative impact surface 43 from the second to the first operating position.

The FIG. 9 variation relates to a different system for moving movable plate 42 of each link 35 between the first and second operating position.

More specifically, in this case, each movable plate 42 is spring loaded into the first operating position by a spring 52, e.g. a cylindrical coil spring, interposed between movable plate 42 and portion 37 of relative link 35. More specifically, spring 52 acts on an end portion of relative movable plate 42 on the opposite side of axis D to the end portion fitted with lateral pins 49.

Each movable plate 42 is therefore normally maintained by spring 52 in the first operating position, and is moved into the second operating position by interacting with cam members 50, which, downstream from the up-sloping ramp guide surfaces 51, define respective flat horizontal guide surfaces (not shown) for maintaining each movable plate 42 in the second operating position in opposition to relative spring 52 as relative pack 3 is transferred to output station 22.

The advantages of unit 1 according to the present invention will be clear from the foregoing description.

In particular, tab 14 of end portion 9 of each pack 3 is folded directly upon pack 3 coming to rest on a relative movable impact surface 43 in the first operating position, thus ensuring a high degree of precision and repeatability, and eliminating any folding inaccuracy caused by flexing the end tabs by sliding them along contrast surfaces.

Moreover, folding tabs 14 of packs 3 as described above in the travelling direction of the packs along path B, i.e. onto the same side as relative longitudinal sealing strips 4, involves only minor alterations to the known folding units described in the introduction to the present description. More specifically, the part (42) of each link 35 initially receiving pack 3 need simply be rendered movable to change the angle of incidence of tab 14 of pack 3 on the impact area. By appropriately opening said angle, with respect to a right-angle, in the travelling direction of packs 3, it is possible, by exploiting the speed of packs 3 and inertia, to fold tab 14 in the desired direction, opposite to that which would be achieved automatically with a 90° angle of incidence. The impact surface 43 of each pack 3 being movable, it is then possible to restore the impact surface to a position perpendicular to the longitudinal axis A of pack 3, so as to complete folding of tab 14 and stabilize the upright travelling position of the pack on conveyor 20.

Clearly, changes may be made to unit 1 without, however, departing from the protective scope defined in the accompanying Claims.

The invention claimed is:

1. A folding unit for producing packages of pourable food products from sealed packs having a longitudinal axis and comprising at least one end tab to be folded and which projects in the direction of said longitudinal axis, said unit comprising:

at least one conveying member which cyclically receives one of said packs, by an end of the pack at which is located said end tab and in a feed direction coaxial with said longitudinal axis, and which feeds the pack along a forming path crosswise to said longitudinal axis; and folding means which interact with each said pack along said forming path to fold the end tab onto the pack;

said folding means comprising an impact surface which receives said pack by the end at which is located said end tab, and which is carried by said conveying member to move between a first operating position, in which said impact surface forms, with the feed direction of said pack, an angle of over 90° and open in the direction of said forming path, so that, upon impacting said end tab, said end tab is folded onto the pack in the travelling direction of the pack along said forming path, and a second operating position, in which said impact surface is rotated towards the pack, with which it cooperates to complete folding of said end tab onto the pack.

2. A unit as claimed in claim 1, wherein, in said first operation position, said impact surface extends parallel to said forming path.

3. A unit as claimed in claim 1, wherein said angle formed between said impact surface in said first operating position and said feed direction is less than 125°.

4. A unit as claimed in claim 3, wherein said angle formed between said impact surface in said first operating position and said feed direction is 115°.

5. A unit as claimed in claim 4, wherein said conveying member comprises a base portion movable along said forming path; and a supporting portion defining said impact surface and connected to said base portion to rotate about a hinge axis crosswise to said forming path and to the longitudinal axis of the relative said pack.

6. A unit as claimed in claim 5, comprising first cam means located along said forming path, downstream from the receiving area of said pack, and which interact with said supporting portion of said conveying member to rotate the supporting portion about said hinge axis and so move said impact surface from said first to said second operating position.

7. A unit as claimed in claim 6, comprising second cam means located along said forming path, upstream from a receiving area of said pack, and which interacts with said supporting portion of said conveying member to rotate the supporting portion about said hinge axis and move said impact surface from said second operating position to said first operating position.

8. A unit as claimed in claim 6, wherein said conveying member comprises elastic means interposed between said base portion and said supporting portion at a distance from said hinge axis, with reference to said forming path, to maintain the impact surface of the supporting portion in said first operating position; said first cam means interacting with said supporting portion of said conveying member in opposition to said elastic means to temporarily move said impact surface into said second operating position.

9. A unit as claimed in claim 8, wherein said at least one conveying member comprises a plurality of articulated conveying members forming an endless conveyor.

10. A unit as claimed in claim 1, wherein said conveying member comprises a base portion movable along said forming path; and a supporting portion defining said impact surface and connected to said base portion to rotate about a hinge axis crosswise to said forming path and to the longitudinal axis of the relative said pack.

11. A unit as claimed in claim 10, comprising first cam means located along said forming path, downstream from the receiving area of said pack, and which interact with said supporting portion of said conveying member to rotate the supporting portion about said hinge axis and so move said impact surface from said first to said second operating position.

12. A unit as claimed in claim 11, comprising second cam means located along said forming path, upstream from a receiving area of said pack, and which interacts with said supporting portion of said conveying member to rotate the supporting portion about said hinge axis and move said impact surface from said second operating position to said first operating position.

13. A unit as claimed in claim 10, wherein said conveying member comprises elastic means interposed between said base portion and said supporting portion at a distance from said hinge axis, with reference to said forming path, to maintain the impact surface of the supporting portion in said first operating position; said first cam means interacting with said supporting portion of said conveying member in opposition to said elastic means to temporarily move said impact surface into said second operating position.

14. A unit as claimed in claim 1, wherein said at least one conveying member comprises a plurality of articulated conveying members forming an endless conveyor.

* * * * *